US005364099A

United States Patent [19]

Kaminkow et al.

[11] Patent Number: 5,364,099

[45] Date of Patent: Nov. 15, 1994

[54] PINBALL MACHINE WITH NOVEL TARGET ASSEMBLY

[75] Inventors: Joseph E. Kaminkow, Arlington Heights; Norman R. Wurz, Chicago, both of Ill.

[73] Assignee: Data East Pinball, Inc., Melrose Park, Ill.

[21] Appl. No.: 181,905

[22] Filed: Jan. 18, 1994

[51] Int. Cl.[5] ..... A63F 7/30

[52] U.S. Cl. ..... 273/127 R; 273/119 R; 273/119 A

[58] Field of Search ..... 273/118, 119, 121, 127, 273/129

[56] References Cited

U.S. PATENT DOCUMENTS

| | | | |
|---|---|---|---|
| 4,971,324 | 11/1990 | Grabel et al. | 273/119 R X |
| 4,981,298 | 1/1991 | Lawlor et al. | 273/121 A |
| 5,123,647 | 6/1992 | Lawlor et al. | 273/121 A |
| 5,158,292 | 10/1992 | Hancher | 273/121 A |
| 5,181,722 | 1/1993 | Krutsch et al. | 273/118 A X |
| 5,186,462 | 2/1993 | Biagi et al. | 273/129 S |

*Primary Examiner*—Vincent Millin
*Assistant Examiner*—Raleigh W. Chiu
*Attorney, Agent, or Firm*—Gerstman, Ellis & McMillin, Ltd.

[57] ABSTRACT

A pinball machine which comprises a housing, a playfield, a motor assembly and a movable assembly is provided. The motor assembly is electronically adapted to respond to the actuation of the targets and is movably connected to the movable assembly. Mechanisms are provided to move the movable assembly from a first position to a second position. The moving mechanisms are operable to return the movable assembly to the first position in response to the actuation of one or more of the targets. In the illustrative embodiment the movable assembly resembles a woman tied to a log on a lumber mill saw table. The first position is the beginning of the saw table and the second position is near a saw blade. The player of the game is prompted to hit specific targets which will save the woman by returning the log to the first position away from the saw blade.

17 Claims, 3 Drawing Sheets

PINBALL MACHINE WITH NOVEL TARGET ASSEMBLY

FIELD OF THE INVENTION

The present invention concerns a pinball machine with a novel target assembly.

BACKGROUND OF THE INVENTION

The object of pinball is to strike targets and score points. In order to make the game more interesting many prior art pinball machines have incorporated bells, buzzers and other sounds as well as flashing lights to keep the player interested in the game. In some pinball machines target assemblies have been designed to interact with the ball. The ball is picked-up by the assembly or the ball is batted away, held or launched by the assembly. In many prior art pinball machines the assemblies are struck and then react in predetermined and programmed ways to manipulate the ball. The manipulations are generally begun by the player striking the target assembly and the manipulations end when the machine's programming determines that the ball should be released.

In the present invention a novel target assembly is incorporated. The novel assembly is set into motion, in any number of manners including the striking of certain targets in a certain order or at random, and the object is to stop the assembly by then striking one or more targets with the ball. The assembly does not manipulate the ball or depend on being directly contacted by the ball to entertain. Further, instead of the assembly being stopped only by its programming, the player can stop and/or stop and reverse the movement by masterly play of the pinball game, including the re-striking of certain targets.

It is therefore an object of the present invention to provide a novel target and assembly that is interesting to play and easy to construct.

It is a further object of the present invention to provide a novel moving target assembly whose movements a player can control through play of the game.

Other objects and advantages of the present invention will become apparent as the description proceeds.

SUMMARY OF THE INVENTION

In accordance with the present invention, a pinball machine which comprises a housing, a playfield, a motor assembly and a movable assembly is provided. The movable assembly is electronically adapted to respond to the actuation of at least one target and is movably connected to the motor assembly.

Means are provided to move the assembly from a first position to a second position. The moving means are operable to return the movable assembly to the first position in response to the actuation of one or more targets.

In the illustrative embodiment the movable assembly resembles a scene from a popular cartoon feature, that of a woman tied to a log on a lumber mill saw table. The first position is the beginning of the saw table and the second position is near the saw blade. The player of the game is prompted to hit a specific target which will save the woman by returning the log to the first position away from the saw blade.

A more detailed explanation of the invention is provided in the following description and claims and is illustrated in the accompanying drawings.

DETAILED DESCRIPTION OF THE ILLUSTRATIVE EMBODIMENT

Figure 1:
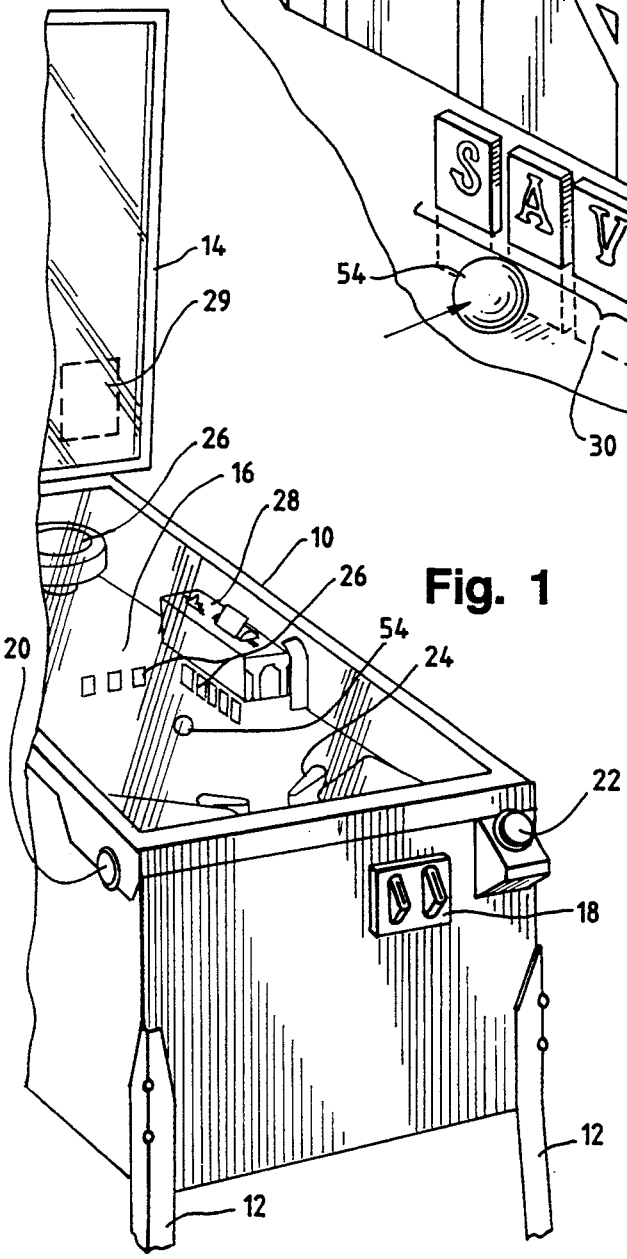
FIG. 1 is a perspective view, partially cut away, of a pinball machine constructed in accordance with the present invention.

Referring to the drawings, FIG. 1 shows a pinball machine comprised of a central body 10 attached to a plurality of legs 12, having a backboard 14. A playfield 16, money accepting means 18, flipper control buttons 20, ball launching means 22, flippers 24, a plurality of targets 26, a play feature 28 and a microcomputer 29 are also provided.

Figure 2:
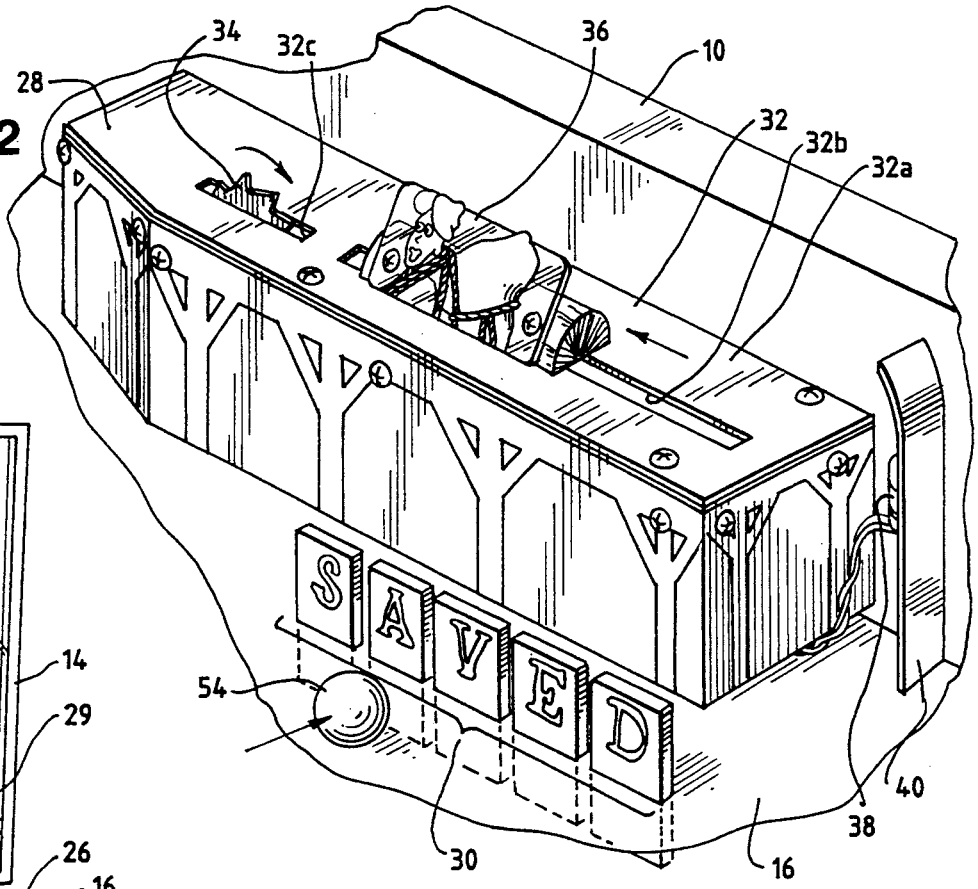
FIG. 2 is an elevational view of a target system designed in accordance with the present invention.

FIG. 2 more clearly shows the play feature 28 of FIG. 1. Play feature 28, comprises a series of targets 30, a play feature housing 32, a moving play feature objective 34, here shown as the blade of a table saw, and a moving sub-assembly 36, here shown as a woman tied to a log on a saw table. Although the play feature objective 34 and moving sub-assembly 36 are shown to resemble a saw (34) and a woman tied to a log (36) on a saw table, it is to be understood that a variety of different characters and situations may be portrayed without departing from the novel scope of this invention.

The top 32*a* of play feature housing 32 defines a first slot 32*b* and a second slot 32*c*. A light 38 to light up play feature 28 and means to protect the light 40 are also provided.

Figure 3:
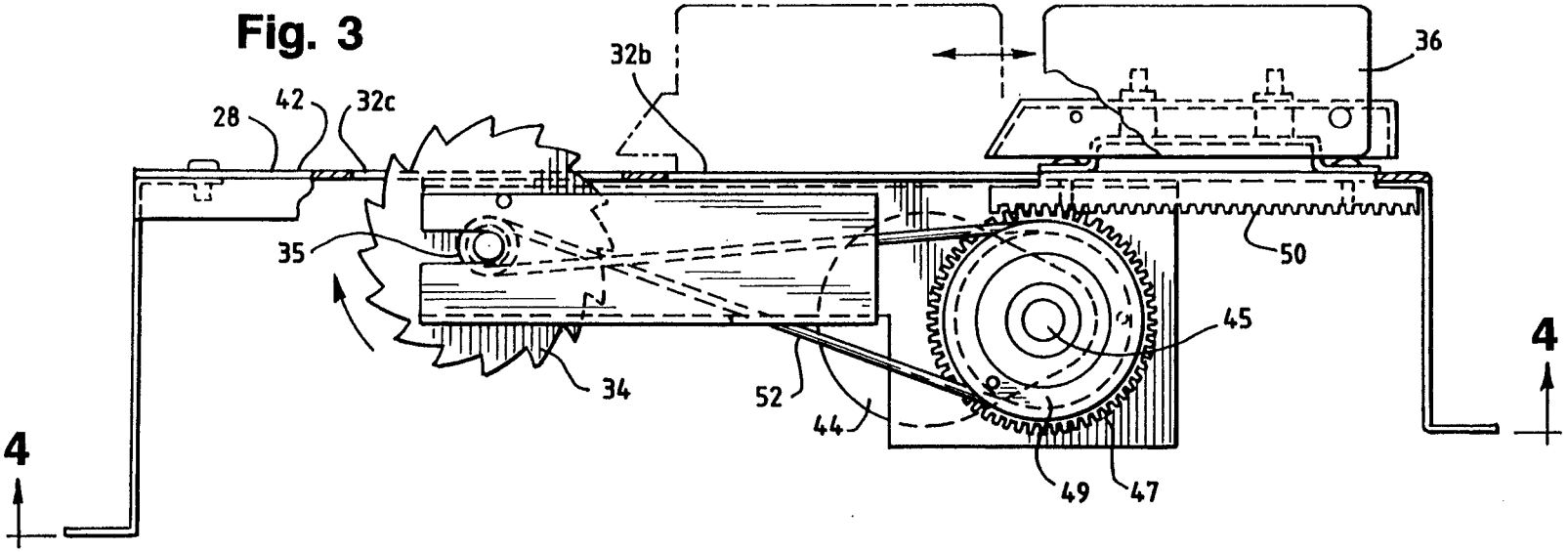
FIG. 3 is a cross sectional view of the target system of FIG. 2.
Figure 4:
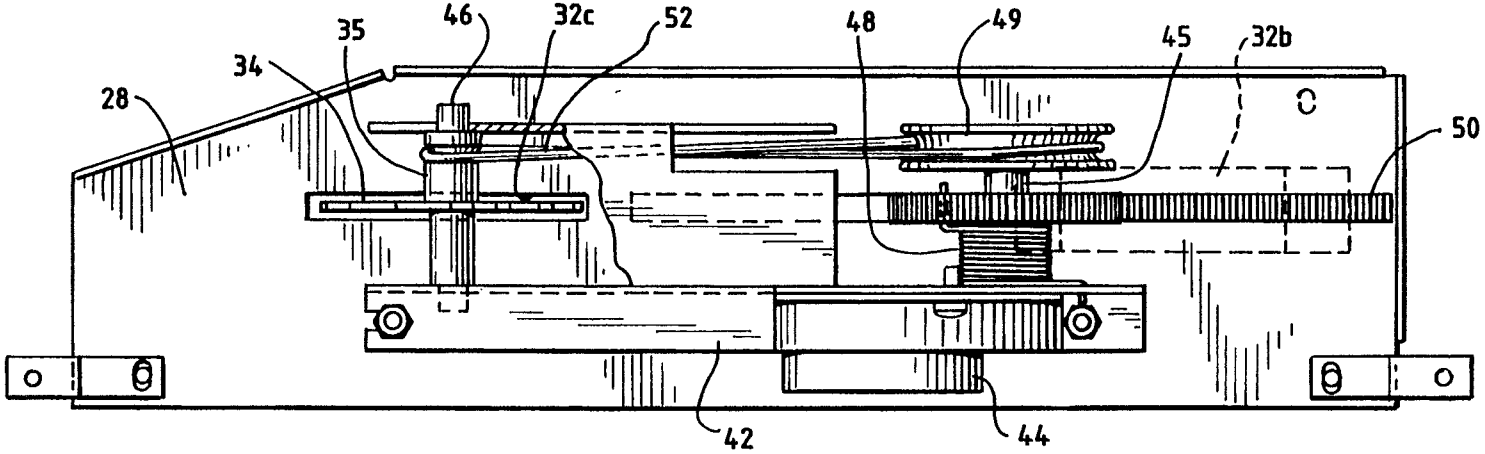
FIG. 4 is a cross sectional view of the target system of FIG. 3, taken along line 4–4.
Figure 5:
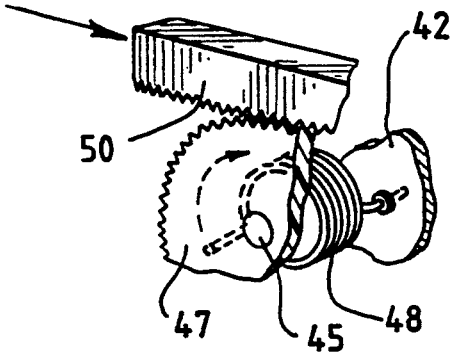
FIG. 5 is an elevational view, partially cut away, of a spring used in the present invention

FIG. 3 and 4 show the inner workings of play feature 28. A mounting bracket 42 is provided to support a motor 44, a gear rack 50 and a first axle 45. A gear 47, spring 48 and pulley assembly 49 are mounted on axle 45. Mounting bracket 42 also supports a second axle 46 which supports play feature objective 34 and pulley assembly 35. Moving sub-assembly 36 is attached to gear rack 50 through first slot 32*b* of play feature housing 32. Play feature objective 34 is mounted so that part of play feature objective 34 emerges through second slot 32*c* of play feature housing 32. Pulley assembly 35 is connected by a band 52 to pulley assembly 49. Band 52 is twisted so that play feature objective 34 turns in the opposite direction to gear 47. In the illustrative embodiment, the twist in band 52 causes the saw blade (34) to turn towards the woman tied to the log (36) as the woman tied to the log (36) nears the blade (34).

In the play of the present invention, a player first strikes each of the series of targets 30 with ball 54. The striking of all of the targets 30 causes microcomputer 29 to engage motor 44. Motor 44 turns axle 45 causing spring 48 to tighten and gear 47 and pulley assembly 49 to turn. As gear 47 turns it inter-engages rack 50, causing rack 50 to move towards play feature objective 34. As pulley assembly 49 turns, band 52 causes pulley assembly 35 to turn in the direction opposite to the direction of turning of gear 47. Moving sub-assembly 36, fixed to rack 50, is caused to move towards play feature objective 34 such that, in the illustrative embodiment, it appears that a woman tied to a log (36) is moving towards a turning saw blade (34).

As play continues, the player is given the opportunity to stop the moving sub-assembly by striking one of the series of targets 30. In the illustrative embodiment, the player is given the opportunity to rescue the woman tied to the log (36) from the saw blade (34). Upon the player causing ball 52 to strike one of the targets 30, the microcomputer 29 disengages motor 44. Spring 48, tightened by the turning of axle 45, is freed and causes rack 50, to spring back to its starting position. As rack 50 is returned to its starting position, sub assembly 36 returns to its starting position. In the illustrative embodiment, the woman tied to the log (36) is saved from the saw blade (34) and is returned to the relative safety of the far end of the saw table.

Although an illustrative embodiment of the invention has been shown and described, it is to be understood that various modifications and substitutions may be made by those skilled in the art without departing from the novel spirit and scope of the invention.

What is claimed:

1. A pinball machine which comprises;
a housing which carries a playfield;
a movable assembly within said housing;
a plurality of targets on said playfield;
moving means, within said housing, electronically adapted to respond to a first actuating of a target, said moving means being movably connected to said movable assembly and actuatable to move said movable assembly from a first position towards a second position;
said moving means being operable to return said movable assembly to said first position in response to a second actuation of a target.

2. The pinball machine of claim 1, in which said movable assembly is configured to appear as a moving sub-assembly and a fixed objective, whereby said sub-assembly moves towards said objective, said objective being positioned proximal to said second position.

3. The pinball machine of claim 1, in which said movable assembly is configured to resemble a woman tied to a log on a saw mill table and a rotating saw blade.

4. The pinball machine of claim 1, in which said moving means comprises a motor, gear, rack, spring and pulley system.

5. The pinball machine of claim 1, in which a spring, tightened by the actuation of said moving means, causes said movable assembly to return to said first position upon said second actuation of a target.

6. The pinball machine of claim 1, in which a microcomputer causes said moving means to respond to the actuation of a target.

7. The pinball machine of claim 1, in which said actuation of said moving means is caused in response to the actuation of a number of targets, said moving means being further operable to return said movable assembly to said first position in response to the second actuation of one or more of said targets.

8. A pinball machine which comprises;
a housing which carries a playfield;
a motor assembly within said housing;
a plurality of targets on said playfield;
a coiled winding spring;
a microcomputer;
a movable sub-assembly, resembling a woman tied to a log on a saw mill table, within said housing,
said motor assembly being connected to said microcomputer such that said microcomputer actuates said motor assembly in response to the actuating of said targets;
means for moving said sub-assembly from a first position towards a second position upon a first actuation of said targets;
said coiled winding spring being wound-up by the movement of said means for moving said sub-assembly and upon a second actuation of at least one of said targets said spring being un-wound causing said means for moving said sub-assembly to return said sub-assembly to said first position.

9. The pinball machine of claim 8, in which said means to move said movable sub-assembly comprises a gear, rack and pulley system.

10. A pinball machine which comprises;
a housing which carries a playfield;
a movable assembly within said housing;
a plurality of targets on said playfield;
moving means, within said housing, said moving means being movably connected to said movable assembly and actuatable to move said movable assembly from a first position towards a second position;
said targets being actuatable in response to being struck by a ball;
said moving means being operable to stop said movable assembly in response to the actuation of at least one of said targets.

11. The pinball machine of claim 10, in which said movable assembly is configured to appear as a moving sub-assembly and a fixed objective, whereby said sub-assembly moves towards said objective, said objective being positioned proximal to said second position.

12. The pinball machine of claim 10, in which said movable assembly is configured to resemble a woman tied to a log on a saw mill table and a rotating saw blade.

13. The pinball machine of claim 10, in which said moving means comprises a motor, gear, rack, spring and pulley system.

14. The pinball machine of claim 10, in which a spring, tightened by the actuation of said moving means, causes said movable assembly to return to said first position upon said second actuation of a target.

15. The pinball machine of claim 10, in which a microcomputer causes said moving means to be actuatable at random.

16. The pinball machine of claim 10, in which a microcomputer causes said moving means to be actuatable in response to the striking of a target.

17. The pinball machine of claim 10, in which said actuation of one of said targets causes said movable assembly to return to said first position.

* * * * *